US009226607B1

(12) United States Patent
Lowman

(10) Patent No.: US 9,226,607 B1
(45) Date of Patent: Jan. 5, 2016

(54) DUAL CURTAIN ROD

(71) Applicant: Melody C. M. Lowman, Harper, TX (US)

(72) Inventor: Melody C. M. Lowman, Harper, TX (US)

( * ) Notice: Subject to any disclaimer, the term of this patent is extended or adjusted under 35 U.S.C. 154(b) by 301 days.

(21) Appl. No.: 13/826,536

(22) Filed: Mar. 14, 2013

Related U.S. Application Data

(60) Provisional application No. 61/611,065, filed on Mar. 15, 2012.

(51) Int. Cl.
*A47H 1/022* (2006.01)

(52) U.S. Cl.
CPC ..... *A47H 1/022* (2013.01)

(58) Field of Classification Search
CPC ..... A47H 1/022; A47H 1/02; A47H 1/102; A47H 1/104; A47H 1/10; A47H 1/12; A47H 1/122; A47H 1/14; A47H 1/142; A47H 1/18; A47H 1/19; A47H 2001/0205; A47H 2001/0215; A47G 25/0692; B60R 7/10
USPC ..... 211/105.1–105.6, 123, 124; 16/87 R
See application file for complete search history.

(56) References Cited

U.S. PATENT DOCUMENTS

| | | | | |
|---|---|---|---|---|
| 2,698,094 | A * | 12/1954 | Simpson | 211/105.3 |
| 2,945,595 | A * | 7/1960 | Gardner, Jr. | 211/105.3 |
| 2,969,881 | A * | 1/1961 | Lilly | 211/105.3 |
| 3,043,438 | A * | 7/1962 | Chmielewski | 211/105.6 |
| 3,166,286 | A * | 1/1965 | Pfaff | 248/263 |
| 3,424,314 | A * | 1/1969 | Cornelsen | 211/105.3 |
| 3,481,483 | A * | 12/1969 | Hill et al. | 211/105.3 |
| 4,426,057 | A * | 1/1984 | Nudo | 248/235 |
| 6,135,403 | A | 10/2000 | Goldstein | |
| 6,145,677 | A * | 11/2000 | Corniel | 211/105.1 |
| 6,488,159 | B2 * | 12/2002 | Shuen | 211/123 |
| 7,143,902 | B2 * | 12/2006 | Iversen et al. | 211/123 |
| 7,252,201 | B1 | 8/2007 | Savage | |
| 7,325,696 | B2 * | 2/2008 | Matthew et al. | 211/105.3 |
| 7,628,363 | B2 * | 12/2009 | Goldstein | 248/261 |
| 7,648,111 | B2 * | 1/2010 | Goldstein | 248/261 |
| D611,328 | S | 3/2010 | Hanley et al. | |
| 8,056,873 | B1 | 11/2011 | Hanley et al. | |
| 8,215,049 | B2 * | 7/2012 | Schuchman | 42/94 |
| 8,341,775 | B2 * | 1/2013 | Didehvar | 4/608 |
| 2002/0014371 | A1 * | 2/2002 | Krause | 182/186.8 |
| 2005/0218283 | A1 * | 10/2005 | Goldstein | 248/251 |
| 2009/0300838 | A1 * | 12/2009 | Didehvar | 4/610 |

* cited by examiner

*Primary Examiner* — Patrick Hawn
(74) *Attorney, Agent, or Firm* — Robert C. Montgomery; Montgomery Patent & Design

(57) ABSTRACT

A dual curtain rod comprises a telescoping traverse rod having a strap and hook member affixed to each end. The strap will fit over and around existing curtain rod brackets and be secured by the hook so as to enable the hanging of an additional set of curtains.

13 Claims, 4 Drawing Sheets

DUAL CURTAIN ROD

RELATED APPLICATIONS

The present invention was first described in and claims the benefit of U.S. Provisional Patent Application No. 61/611,065 filed on Mar. 15, 2012, the entire disclosures of which are incorporated herein by reference.

FIELD OF THE INVENTION

The present invention relates to a curtain rod assembly having an inner rod telescopingly adjustable within an outer rod and a pair of strap assemblies enabling adjustable connection to an existing support bracket.

BACKGROUND OF THE INVENTION

It is sometimes desirous to complement window and similar structural openings with various treatments, valances, and curtains. A common and effective method to facilitate this is the use of a lateral support rod. This lateral support rod is typically affixed, or otherwise secured, near a top region of such an opening to hold drapery-like material of an assortment of shapes and designs. Those exhibiting the desire to complement such openings have an innate artistic urge to be afforded the ability to have a more robust treatment display. Not only should there be an ability to have a robust treatment display, but there should be a means to alternate from a less robust to a more robust display at the discretion of the decorator and with minimal effort and cost. Any artisan covets a tool that provides robustness in its appearance and expression while limiting complexity in its use.

Curtain and valance rods already exist. Existing art in the field also provide versatility by incorporating dual rod systems that are extendable. However, prior art fails to afford the utilization of an auxiliary rod in conjunction with an existing curtain rod to generate a multiple rod system at the discretion of a decorator. It is desirable to have an easily removable curtain rod that is used with an existing stationary curtain rod. A beneficial feature is for this device to attach to and detach from an existing curtain rod with ease. It is further desirable for the device to attach in such a way as to allow a user to create a tessellation of treatments rather than a mere dual rod system.

SUMMARY OF THE INVENTION

The present invention relates to an extendable rod attached to, and used in conjunction with, existing curtain or valance rods. When in place, the extendable rod provides an additional support rod in juxtaposition with an existing curtain or valance rod to create a multiple rod system.

The telescoping dual curtain rod comprises of a cylindrical outer rod and a cylindrical inner rod. The outer rod telescopingly receives the inner rod to assemble into a two-rod configuration. The two-rod configuration has an outer rod free end at a distal end of the outer rod and an inner rod free end at a distal end of the inner rod. In an assembled configuration, the outer rod free end is equipped with a first strap and a first hooking member, whereas the inner rod free end is equipped with a second strap and a second hooking member. The first strap and first hooking member further comprises of a ring, a strap having a plurality of apertures, and a hook. The second strap and second hook member are similarly configured, but having a ring of smaller diameter so that the inner ring can be correspondingly fitted onto the end of the inner rod. In use, the second strap is wrapped around an existing support and affixed to the second hook.

A user wraps the second strap around an existing support bracket and secures the second strap to the second hook. At least one (1) treatment or curtain is slidably attached to the outer rod. The outer rod is slid onto the inner rod until the first strap and first hook member can be brought into proximity to an opposite existing support bracket. The first strap is wrapped around the support bracket and secured to the first hook.

Decorating window and similar structural openings should neither be limited to the use of one (1) curtain rod, nor to a curtain rod having a dual lateral support rod. It is desirous to have the ability to quickly and easily add or remove additional lateral support rods to create a tessellation of treatments at the discretion of the decorator. It is further desirous to use such a device to tailor the robustness of the treatment display with minimal cost and complexity.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
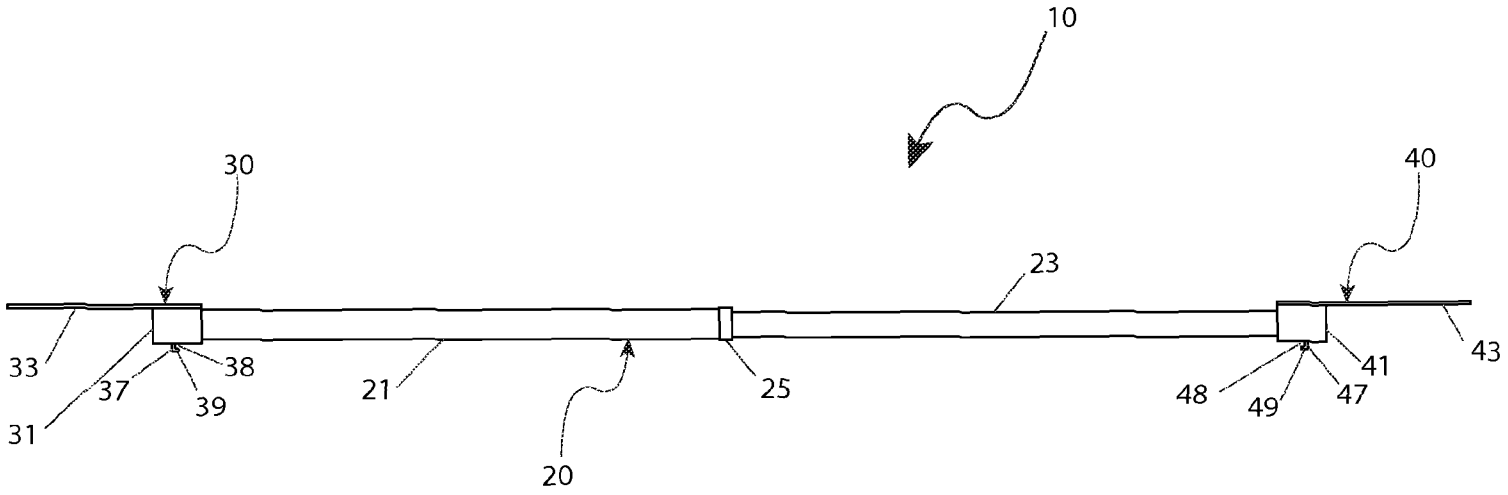
FIG. 1 is a front view of a complete telescoping dual curtain rod 10, according to a preferred embodiment of the present invention.

10 dual curtain rod
20 telescoping rod assembly
21 outer rod
23 inner rod
25 protective sleeve
30 outer rod strap and hook member
31 outer rod ring
33 outer strap
35 outer strap aperture
37 outer hook
38 outer gap
39 outer bite
40 inner rod strap and hook member
41 inner rod ring

43 inner strap
45 inner strap aperture
47 inner hook
48 inner gap
49 inner bite
100 support bracket
101 curtain panel

DETAILED DESCRIPTION OF THE PREFERRED EMBODIMENT

The best mode for carrying out the invention is presented in terms of its preferred embodiment, herein depicted within FIGS. 1 through 4*b*. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a telescoping dual curtain rod (herein described as the "apparatus") 10 which provides a means for suspending an additional set of curtain panels 101 on the support brackets 100 of an existing curtain rod installation without the need to make any modifications to said brackets or installing additional support hardware. It is easily recognized that the apparatus 10, despite the naming of the invention, can also be utilized on the support brackets of an existing double curtain installation to add a third layer of treatment to fenestration.

Referring now to FIG. 1, a view of a complete telescoping dual curtain rod 10, according to a preferred embodiment of the present invention is disclosed. The apparatus 10 comprises a cylindrical outer rod 21 with an outer rod strap and hook member 30 affixed to one (1) end, and a protective sleeve 25 affixed to the opposite end. An inner cylindrical rod 23, having a smaller cross-section, is assembled and telescopingly attached to the end of the outer rod 21 on which the protective sleeve 25 is affixed and an inner rod strap and sleeve member 40 affixed to the free end. The outer rod 21 and the inner rod 23 are fabricated from steel tubing, preferably complying with drawn over mandrel specification, of a size and gauge to achieve a running slide fit compensating for the inside diameter of the protective sleeve 25. The outer rod 21 and the inner rod 23 are preferably plated with a protective material to inhibit rusting. The protective sleeve 25 is preferably comprised of a nylon tube, or other rugged polymer material, folded back on itself into a cup so that the protective sleeve 25 can be inserted onto the free end of the outer rod 21 with the end of the outer rod 21 fitting into the cup and the protective sleeve 25 covering both the inside wall and the outside wall of the outer rod 21, in an interference fit, for a suitable length. The purpose of the protective sleeve 25 being to cover the end of the outer rod 21 at the insertion point of the inner rod 23 to prevent any sharp edges or burrs, arising from the fabrication process, from scratching the inner rod 23 or snagging the user's new curtain panel 101, and to greatly assist the installation of the curtain panel 101 on the apparatus 10.

Figure 2A:
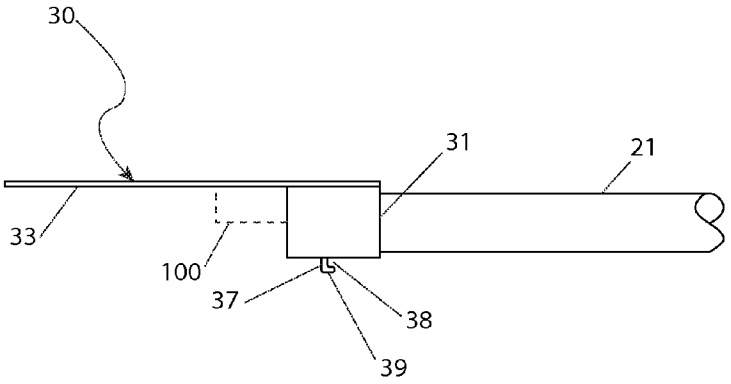
FIG. 2*a* is an enlarged elevation view of the end of an outer rod 23 of the dual curtain rod 10 in juxtaposition with a typical cross-section of an existing curtain rod support bracket 100 according to a preferred embodiment of the present invention.
Figure 2B:
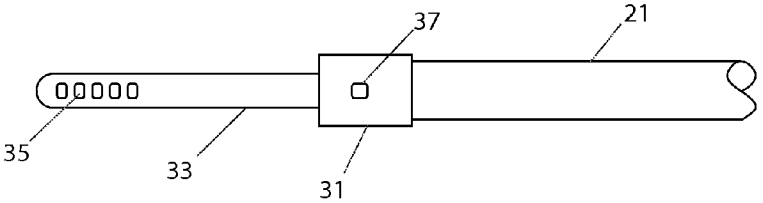
FIG. 2*b* is a bottom view of that same end, with no bracket for clarity, according to a preferred embodiment of the present invention.
Figure 3A:
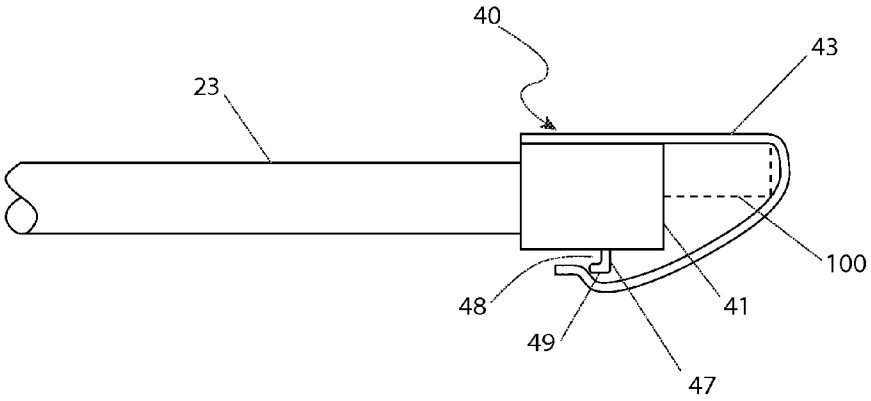
FIG. 3*a* is an enlarged view of the end the inner rod 23 of the dual curtain rod 10 with a strap portion 43 according to a preferred embodiment of the present invention.

Referring now to FIGS. 2*a* and 2*b*, an enlarged view of the end of the outer rod 21 of the apparatus 10 is shown with an example of a cross-section of an existing curtain rod support bracket 100. The outer rod strap and hook member 30 is comprised of an annular outer ring 31, an outer strap 33 with series of outer apertures 35, and an outer hook 37. The inner rod strap and hook member 40, as shown in FIG. 3*a*, is similarly comprised of an inner annular ring 41, an inner strap 43 with a series of inner apertures 45, and an inner hook 47. The apertures 35 and 45 are aligned along a central longitudinal line of the distal end of the straps 33 and 43. The difference between the outer rod strap and hook member 30 and the inner rod strap and hook member 40 being the inside diameter and consequently the wall thickness of the rings 31 and 41. The inside diameter of the outer ring 31 will be slightly larger than the inside diameter of the inner ring 41 so that the outer ring 31 can be fitted onto the end of outer rod 21, while the inner ring 41 can be correspondingly fitted onto the end of the inner rod 23 which is smaller in diameter. While this embodiment presents that the outside diameters of the rings 31 and 41 be close to identical, that would not necessarily be absolute as the user would not be cognizant of the difference over the span of the apparatus 10 and it would not violate the intentions of this invention.

Figure 3B:
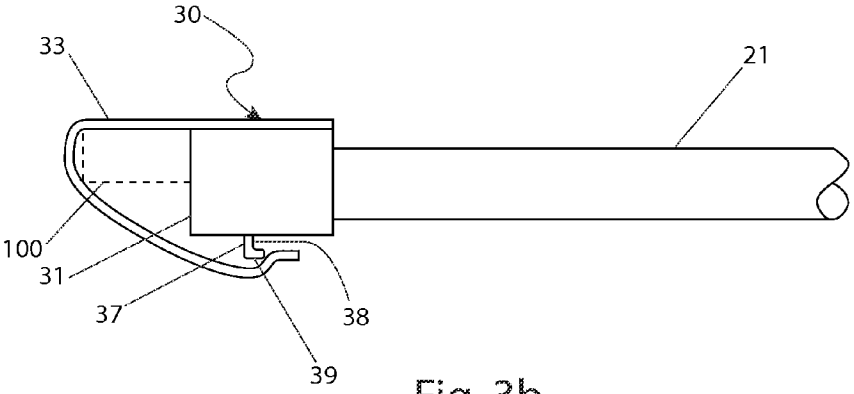
FIG. 3*b* is an enlarged view of the end of the outer rod 21 of the dual curtain rod 10 with a strap portion 33, according to a preferred embodiment of the present invention.

Referring now to FIGS. 3*a* and 3*b*, a view of the inner rod strap and hook member 40 is shown. The inner rod strap and hook member 40 is preferably formed of a polymer material in one (1) piece, entailing all of the parts, inner ring 41, inner strap 43 with inner strap apertures 45, and inner hook 47. The material used in the fabrication of the inner rod strap and hook member 40 would be somewhat elastic so as to permit the inner strap 43 to be wrapped over the top and side of an existing support bracket 100 and engage the inner hook 47 on the bottom of the inner ring 41 into one (1) of the inner strap apertures 45. The inner hook 47 will be fabricated with a minimal inner bite 49 to reduce the amount of stretch in the inner strap 43 required to engage the inner hook 47 into the appropriate inner strap aperture 45. The inner gap 48 of the inner hook 47 will be sufficient to accommodate the thickness of the inner strap 43. An alternate method for fabricating the inner rod strap and hook member 40, while still satisfying this embodiment, would be to fashion the inner hook 47 as a metal insert and install said inner hook 47 into the mold of said inner strap and hook member 40. The outer rod strap and hook member 30 would be fabricated in a similar manner.

Figure 4B:
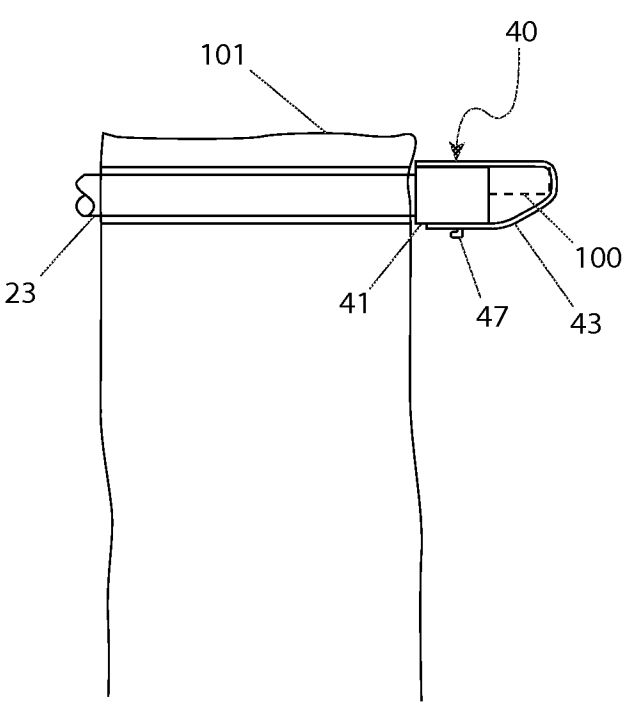
FIG. 4*a* is an elevation break-away view of the end of the outer rod 21 of the dual curtain rod 10 in a typical installation according to a preferred embodiment of the present invention; and, FIG. 4*b* is an elevation break-away view of the end of the inner rod 23 of the dual curtain rod 10 in a typical installation according to a preferred embodiment of the present invention.
Figure 4A:
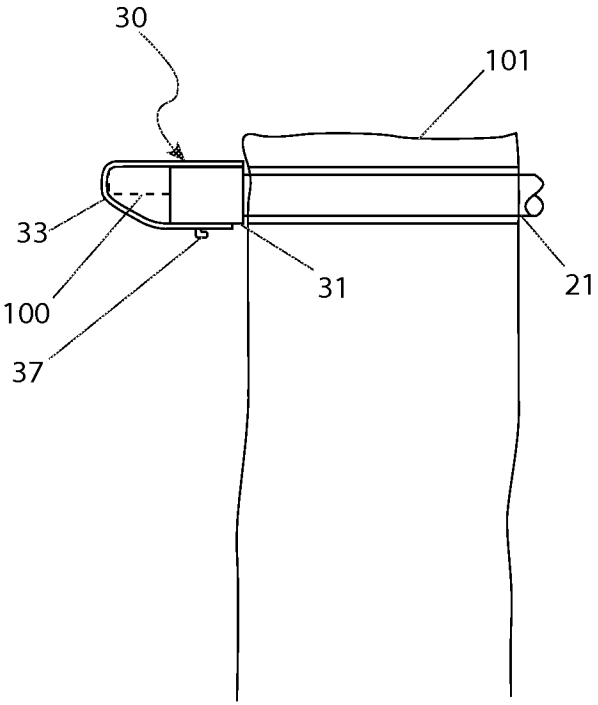

The preferred embodiment of the present invention can be utilized by any enabled user in a simple and straightforward manner with little or no training. After initial purchase or acquisition of the apparatus 10, it would be installed as indicated in FIGS. 4*a* and 4*b*.

The method of installing and utilizing the apparatus 10 may be achieved by performing the following steps: acquiring a model of the apparatus 10 having the desired range of extension to accommodate the span between the existing curtain brackets 100; installing the inner rod 23 with the attached inner rod strap and hook member 40 by wrapping the inner strap 43 over and around the existing support bracket 100 and engaging the inner hook 47 into a desired inner strap aperture 45 to ensure a secure fit; sliding the required number of user's new curtain panels 101 over the protective sleeve 25 and onto the outer rod 21; engaging the free end of the inner rod 23 into the protective sleeve 25 and subsequently into the end of the outer rod 21; sliding the outer rod 21, with the new curtain panels 101, onto the inner rod 23 until the outer rod strap and hook member 30 can be brought into proximity to the opposite existing support bracket 100; wrapping the outer strap 33 over and around said support bracket 100, and engaging the outer hook 32 into a desired outer strap aperture 35 in the outer strap 33 to assure a secure fit; and arranging the new curtain panels 101 across the entire telescoping rod assembly 20 to suit the user's sense of style.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A telescoping dual curtain rod assembly, comprising:

a receiving rod having a first receiving end and a second receiving end, and further comprising:

a first strap assembly attached to said first receiving end, said first strap assembly including a first strap having a first strap aperture and a first hook member with a first bite; and, a protective sleeve on said second receiving end;

an inserting rod having a first inserting end and a second inserting end and further comprising:

said first inserting end telescopingly inserted into said second receiving end; and, a second strap assembly attached to said second inserting end, said second strap assembly including a second strap having a second strap aperture and a second hook member with a second bite;

wherein said first strap is sufficiently elastic to form a first loop such that said first strap aperture can receive said first bite;

wherein said second strap is sufficiently elastic to form a second loop such that said second strap aperture can receive said second bite.

2. The assembly of claim 1, wherein said receiving rod and inserting rod is fabricated from steel tubing.

3. The assembly of claim 2, wherein said receiving rod and inserting rod are plated with a protective material to inhibit rusting.

4. The assembly of claim 1, wherein said protective sleeve further comprises a polymeric material.

5. The assembly of claim 1, wherein said first strap assembly extends outwardly from said first receiving end and further comprises:

a first annular ring;

a first strap body extending outwardly from said first annular ring; and, a plurality of first apertures linearly disposed on said first strap body.

6. The assembly of claim 5, wherein said second strap assembly extends outwardly from said second inserting end and further comprises:

a second annular ring;

a second strap body extending outwardly from said second annular ring; and, a plurality of second apertures linearly disposed on said second strap body.

7. A telescoping dual curtain rod assembly, comprising:

a receiving rod having a first receiving end and a second receiving end, and further comprising:

a first strap assembly attached to said first receiving end, said first strap assembly including a first strap having a first strap aperture and a first hook member with a first bite affixed thereto; and, a protective sleeve on said second receiving end;

an inserting rod having a first inserting end and a second inserting end and further comprising:

said first inserting end telescopingly attached to said second receiving end; and, a second strap assembly attached to said second inserting end, said second strap assembly including a second strap having a second strap aperture and a second hook member with a second bite affixed thereto;

wherein said protective sleeve has a cup portion which said second receiving end is slidably fitted into such that said protective sleeve covers an inner wall and an outer wall of said receiving rod;

wherein said first strap is sufficiently elastic to form a first loop such that said first strap aperture can receive said first bite; and, wherein said second strap is sufficiently elastic to form a second loop such that said second strap aperture can receive said second bite.

8. The assembly of claim 7, wherein said receiving rod and inserting rod is fabricated from steel tubing.

9. The assembly of claim 7, wherein said receiving rod and inserting rod are plated with a protective material to inhibit rusting.

10. The assembly of claim 7, wherein said protective sleeve further comprises a polymeric material.

11. The assembly of claim 7, wherein said first strap assembly extends outwardly from said first receiving end and further comprises:

a first annular ring;

a first strap body extending outwardly from said first annular ring; and, a plurality of first apertures linearly disposed on said first strap.

12. The assembly of claim 11, wherein said second strap assembly extends outwardly from said second inserting end and further comprises:

a second annular ring;

a second strap body extending outwardly from said second annular ring; and, a plurality of second apertures linearly disposed on said second strap.

13. The assembly of claim 12, wherein said first hook member and second hook member are each a metallic structure.

* * * * *